United States Patent [19]

Eberbach

[11] 4,315,102

[45] Feb. 9, 1982

[54] SPEAKER CROSS-OVER NETWORKS

[76] Inventor: Steven J. Eberbach, 724 S. Division, Ann Arbor, Mich. 48104

[21] Appl. No.: 22,601

[22] Filed: Mar. 21, 1979

[51] Int. Cl.[3] ..... H04R 3/14

[52] U.S. Cl. ..... 179/1 D; 179/175.1 A

[58] Field of Search ..... 336/45, 130, 136, 211; 179/1 D, 175.1 A; 333/28 T, 132, 177, 178, 179, 180

[56] References Cited

U.S. PATENT DOCUMENTS

| | | | |
|---|---|---|---|
| 1,907,723 | 5/1933 | Bostwick | 179/1 D |
| 1,931,235 | 10/1933 | Nicolson | 179/1 D |
| 2,452,560 | 11/1948 | Gainer | 333/178 |
| 2,612,558 | 9/1952 | Klipsch | 179/1 D |
| 2,727,949 | 12/1955 | Lokkesmoe | 179/1 D |
| 2,957,124 | 10/1960 | Shamblin | 336/136 |
| 3,239,782 | 3/1966 | Henke | 336/136 |
| 3,457,370 | 7/1969 | Boner | 179/1 D |
| 3,684,993 | 8/1972 | Hazen et al. | 336/136 |
| 3,838,215 | 9/1974 | Haynes, Jr. | 179/1 D |
| 3,838,216 | 9/1974 | Watkins | 179/1 A |
| 4,015,089 | 3/1977 | Ishii et al. | 179/1 D |
| 4,031,321 | 6/1977 | Bakgaard | 179/1 D |

FOREIGN PATENT DOCUMENTS

| | | | |
|---|---|---|---|
| 1108268 | 6/1961 | Fed. Rep. of Germany | 179/1 D |

OTHER PUBLICATIONS

Onkyo Speaker Components Brochure.

*Primary Examiner*—James W. Moffitt
*Assistant Examiner*—Randall P. Myers
*Attorney, Agent, or Firm*—James M. Deimen

[57] ABSTRACT

The invention comprises improved electroacoustic audio speaker cross-over networks. The improvements comprise both the addition of various passive elements and a novel inductively coupled circuit configuration. The improvements are applied to low pass and high pass networks and combinations thereof. In the preferred embodiments a separate electrical circuit is inductively coupled to the filter network. The physical configuration of the separate circuit can be easily adjusted to counter variations in individual speaker performance parameters. Thus, production variations in speakers from the same manufacturer or among the products of different manufacturers can be overcome and a better matching of speakers provided.

In the simplest embodiment the separate inductively coupled circuit comprises a copper ring placed within an inductive coil of the filter. Adjustment is accomplished by adjusting the physical location within the coil or by small changes in the physical dimensions of the ring.

33 Claims, 12 Drawing Figures

SPEAKER CROSS-OVER NETWORKS

BACKGROUND OF THE INVENTION

The field of the invention pertains to electroacoustic audio reproduction systems, the most common examples of which are monophonic and stereophonic speaker systems. Best individual speaker or driver performance is severely limited within the normal range of hearing (about 20–20,000 Hz). Acoustic output and efficiency become severely limited outside of the frequency range of best performance. This may be at the upper or lower end of the frequency range depending on the particular driver.

One approach to the problem is U.S. Pat. No. 3,497,621 wherein a low frequency compensation circuit for a single speaker is disclosed. A second compensating circuit for a single speaker is disclosed in U.S. Pat. No. 3,838,216.

A more contemporary approach is to provide multiple separate speakers or drivers to cover the entire range of frequencies. Electronic cross-over or filter networks are utilized to feed low frequencies to low frequency drivers ("woofers") and high frequencies to high frequency drivers ("tweeters"). U.S. Pat. No. 2,802,054 discloses the use of a cross-over network and compensating network for separate low and high frequency speakers. Disclosed in U.S. Pat. No. 3,727,004 is an electronic cross-over or filter network for a multiple speaker system sold commercially. Cross-over or filter circuits incorporating additional passive electronic elements for both two and three speaker systems are disclosed in U.S. Pat. No. 3,838,215. However, despite extensive speaker circuit development, the quest for better speaker performance continues in the attempt to meet the public desire for a more perfect reproduction of sound and in particular music.

SUMMARY OF THE INVENTION

The invention comprises improvements in electroacoustic audio speaker cross-over or filter networks. The improvements comprise both the addition of various passive elements and a novel inductively coupled circuit configuration. A separate electrical circuit is inductively coupled to the filter network and is conveniently adjustable during assembly to vary the quality factor (Q-factor) of the filter. The inductively coupled circuits may be used with either the high pass, low pass or both filter networks of the cross-over. The physical configuration of the separate circuit can be easily adjusted to counter variations in individual speaker or driver performance parameters. Thus, production variations in drivers from the same manufacturer although within specifications or among the products of different manufacturers can be compensated and a better matching of speakers in a system accomplished.

In the simplest embodiment the separate inductively coupled circuit comprises a copper ring placed within an inductive coil of the filter. Adjustment is accomplished by adjusting the physical location within the coil or by small changes in the physical dimensions of the ring. As an alternative the separate circuit can be a secondary coil with a suitable cross-section and number of turns. This alternative allows a switch or disconnect to be incorporated in the inductively coupled circuit to switch in the inductively coupled circuit when desired.

DESCRIPTION OF THE PREFERRED EMBODIMENTS

Figure 1:
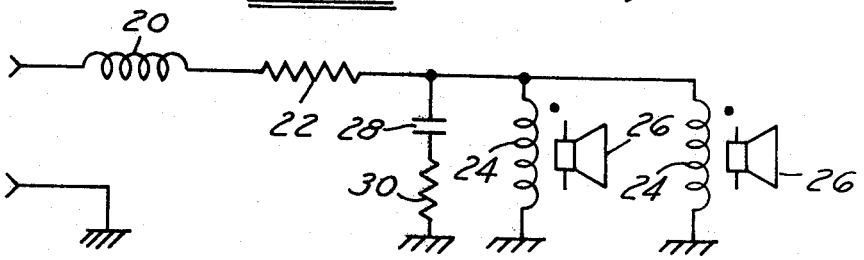
FIG. 1 (PRIOR ART)
FIG. 1 is a schematic of a typical low pass filter network and dual low frequency drivers.

In FIG. 1 a typical low pass filter network and drivers are shown schematically. An inductance 20 and resistance 22 are in series with parallel coils 24 of drivers 26. A capacitance 28 and second resistance 30 are in parallel with the driver coils. The resistance may be the inherent resistance of the inductance and capacitance or additional resistive elements. To accommodate the individual electroacoustic characteristics of a single driver or the dual drivers shown, the inductance 20, capacitance 28 and resistances 22 and 30 are selected to compensate for large scale performance inadequacies. Such selection is done at the design stage or just before the assembly stage of the network-driver combination.

Figure 2:
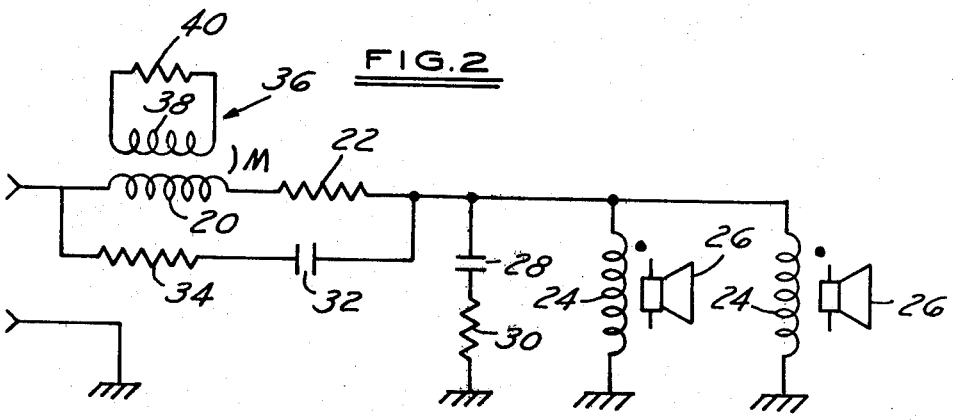
FIG. 2 is a schematic of a modified low pass filter network and dual low frequency drivers.

In FIG. 2 the network retains the capacitance 28 and resistance 30. A second capacitance 32 and resistance 34 are added in parallel to the inductance 20 and resistance 22 to increase the impedance of the network above the upper cutoff frequency of the drivers. Again the resistance 34 may be inherent in the capacitance 32 or also include a separate discrete resistance. Magnetically coupled to the inductance 20 is a second circuit generally denoted by 36. The inductively coupled circuit 36 comprises an inductance 38 and resistance 40, however, in one preferred embodiment the resistance 40 comprises the inherent resistance of the coil forming the inductance 38. Thus, the inductively coupled circuit 36 comprises a shorted coil.

Figure 3:
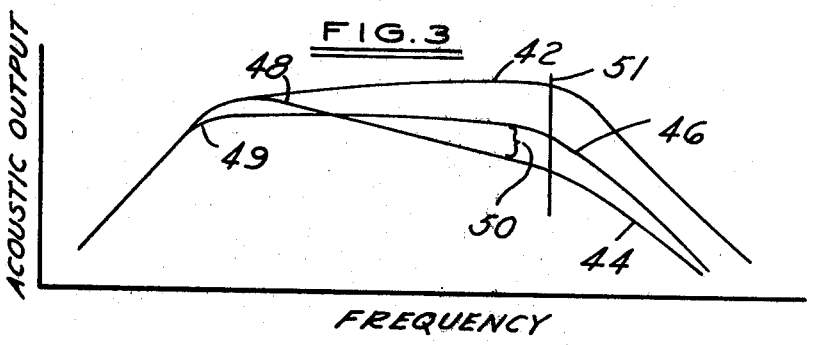
FIG. 3 is a plot of frequency versus acoustic output for a low frequency driver.

The effect of the shorted coil 36 on the performance of the drivers 26 in terms of acoustic output versus frequency is illustrated in FIG. 3. Curve 42 illustrates the response of typical low frequency drivers without the filter network of FIG. 1. Curve 44 illustrates the typical response of the same drivers with the filter network of FIG. 1. Curve 46 illustrates the effect of the inductively coupled circuit 36 of FIG. 2.

In a network assembled according to the schematic of FIG. 2 for a pair of Heppner (Heppner Manufacturing Co., P.O. Box Q, Round Lake, Ill.) 6½ inch prototype low frequency drivers, the hump 48 in curve 44 was cut ¼ to 1 db at 300 Hz and the dip 50 was raised 1 to 4 db between 1 and 4 kHz. By properly choosing the inductance of the shorted coil 36 the response of the drivers is effectively leveled over the portion of the curve between the upper 51 (4 kHz) and lower 49 (50 Hz) cutoff frequencies of the drivers.

Figure 4:
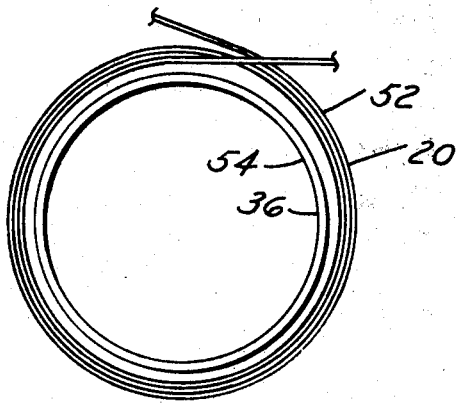
FIG. 4 is a side view of the inductively coupled circuit.

FIG. 4 illustrates a particularly effective configuration for the shorted coil 36 and inductance 20. The inductance 20 comprises a multiple turn coil of insulated coil wire 52 surrounding a copper ring 54. The copper ring comprises the shorted coil or inductively coupled circuit 36. The ring is about two inches in diameter with a thickness of about 1/16 inch and depth of ½ inch. Rings may be conveniently formed by taking slices of copper pipe. By either adjusting the depth of the ring when cutting from the pipe or the depth of placement of the ring within the coil 52, the reactance and Q-factor of the filter can be adjusted to suit an individual driver or several essentially identical drivers. In practice drivers are carefully tested and the ring positioned within the coil during assembly to correct for variations in driver or speaker parameters. A skilled technician utilizing the combination of a noise generator, microphone and spectrum analyzer or the combination of an impulse excitation signal, microphone and oscilloscope can finely adjust the response of the filter-driver network.

The ring alternatively can surround the coil 52 or be tilted with respect to the coil 52, the important factor being the proper magnetic coupling of the inductance 20 to the ring 54. The selection of the final relative position of the coil 52 to the ring 54, once made, may be retained by cementing the parts to an insulated support in the same relative position. Alternatively, the ring may be mounted on an adjustable fixture so that the magnetic coupling may be varied subsequent to assembly. The post assembly adjustable ring has been found very effective as a mid range (between driver lower and upper cutoff frequencies) tonal balance adjustment control. The size and geometric position of the ring 54 relative to the coil 52 determine the shift of the curve 44 to the curve 46 in FIG. 3.

Figure 5:
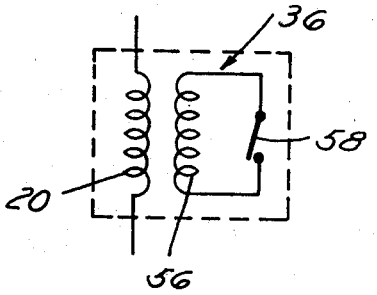
FIG. 5 is a schematic of an alternative form of the inductively coupled circuit.

An alternative form of the inductively coupled circuit 36 is shown schematically in FIG. 5. The inductance 20 again may comprise a multiturn coil of insulated wire. The inductively coupled circuit 36, however, comprises a coil 56 of one or more turns and a disconnect or shorting switch 58 in the circuit. The inductively coupled shorted circuit may thereby be selectably added or deleted from the filter network as desired. The inductively coupled circuit 36 is not limited to the shorted coil, the inductance and separate resistance or the inductance and shorting switch disclosed above but may incorporate additional passive elements.

Figure 6:
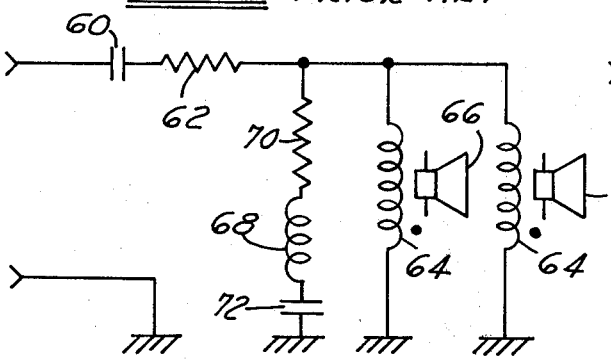
FIG.6 PRIOR ART
FIG. 6 is a schematic of a typical high pass filter network and dual high frequency drivers.

In FIG. 6 a typical high pass filter network and driver is shown schematically. The network comprises a capacitance 60 and resistance 62 in series with the driver coils 64 of high frequency drivers 66 and an inductance 68, second resistance 70 and second capacitance 72 in parallel with the driver coils 64. As above the resistance may be the inherent resistance of the inductance or capacitance or additional discrete resistive elements. To accommodate the electroacoustic characteristics of the drivers, the values of inductance, capacitance and resistance are selected to compensate for large scale driver performance inadequacies. Such selection is done at the design stage or just before the assembly stage of the network-driver combination.

Figure 7:
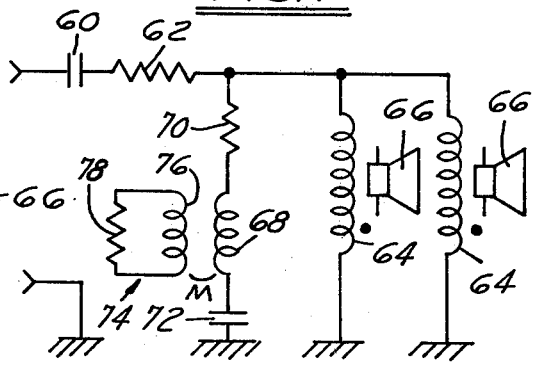
FIG. 7 is a schematic of a modified high pass filter network and dual high frequency drivers.

In FIG. 7 a modified form of the high frequency filter network retains the capacitance 60 and resistance 62 as well as the inductance 68, resistance 70 and capacitance 72. Inductively coupled to the inductance 68 is a second circuit generally denoted by 74 comprising an inductance 76 and resistance 78. Again in the preferred embodiment the second circuit comprises a shorted coil wherein the resistance 78 is that inherent in the inductance 76. A copper ring as disclosed above provides a particularly effective shorted coil for the high pass filter network. For best performance the resistance 70 should be as low as possible, preferably no more than that inherent in the inductance 68, capacitance 72 and connecting wires.

Figure 9:
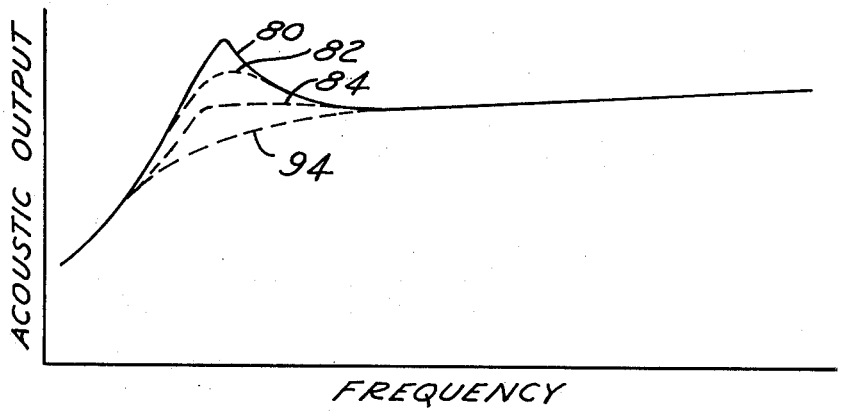
FIG. 9 is a plot of frequency versus acoustic output for a high frequency driver.

In FIG. 9 the effect of various passive elements in the high pass filter network is shown. The peak of curve 80 occurs at approximately the lower resonant cutoff frequency of the driver. In the case of curve 80 for a driver with a lower cutoff frequency of 1000 Hz, the filter consisted of the series capacitance 60 and resistance 62. Such a filter is conventionally modified by adding the inductance 68 resulting in curve 82 and possibly the capacitance 72 resulting in curve 84. The combination of inductance 68 and capacitance 72 are normally selected for resonance at the driver resonant frequency and to modify the input impedance of the filter to complement the electromechanical impedance of the driver at the resonant frequency.

Figure 10:
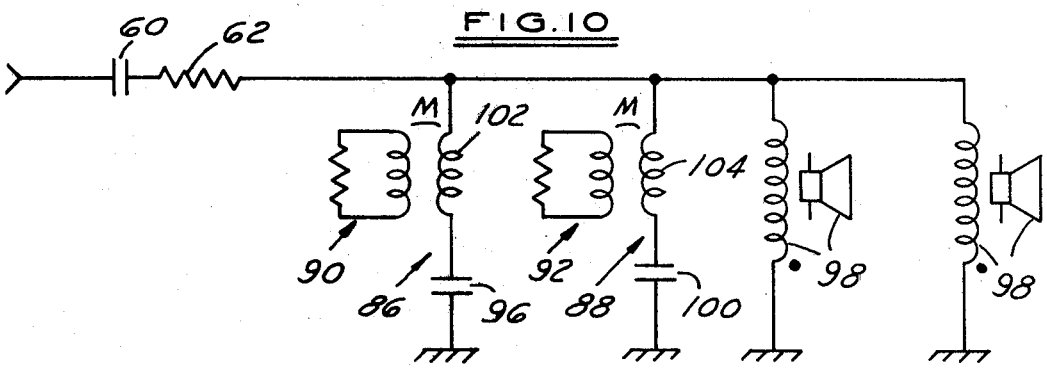
FIG. 10 is a schematic of a further modified high pass filter network and dual high frequency drivers.

Although obtaining a fairly flat frequency response (curve 84) the associated phase angle response and frequency roll-off can be further improved by adding the inductively coupled circuit 74 shown in FIG. 7 or the plural resonant circuits 86 and 88 and inductively coupled circuits 90 and 92 shown in FIG. 10. The latter network provides the smooth roll-off of curve 94 in FIG. 9 and a very flat phase response. Capacitance 96 is selected for resonance at the resonant frequency of the pair of drivers 98 and capacitance 100 is selected for resonance at a frequency above the driver resonant frequency. Typically, capacitance 100 is selected to be 7/10ths of capacitance 96. Alternatively, the inductance 104 is selected to be 7/10ths the inductance of inductor 102. The inductively coupled circuits 90 and 92 may very satisfactorily consist of a pair of copper ring shunts as described above and properly positioned with respect to the respective coils 102 and 104.

The actual values chosen for the elements of the high pass filter network of FIG. 7 or FIG. 10 are obtained by the empirical analysis of the step response or impulse response of the high frequency drivers. The frequency and phase response are derived from a Fourier analysis of the impulse or step response. The importance of a flat phase response appears in the superior efficiency of the dual low frequency and high frequency driver and cross-over network combinations shown in FIGS. 8 and 11.

Figure 8:
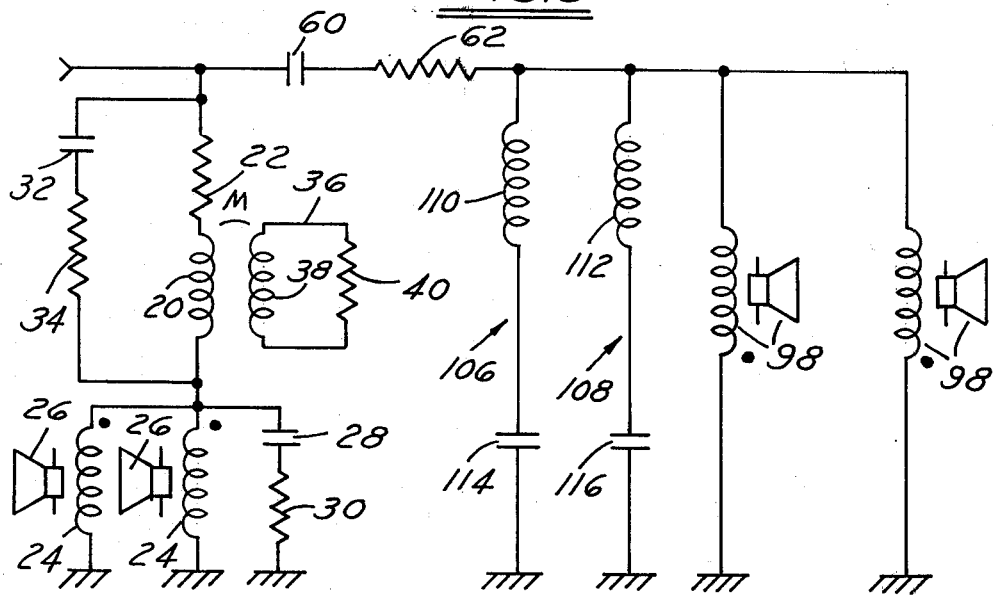
FIG. 8 is a schematic of a cross-over network incorporating one inductively coupled circuit and a high pass resonant filter.
Figure 11:
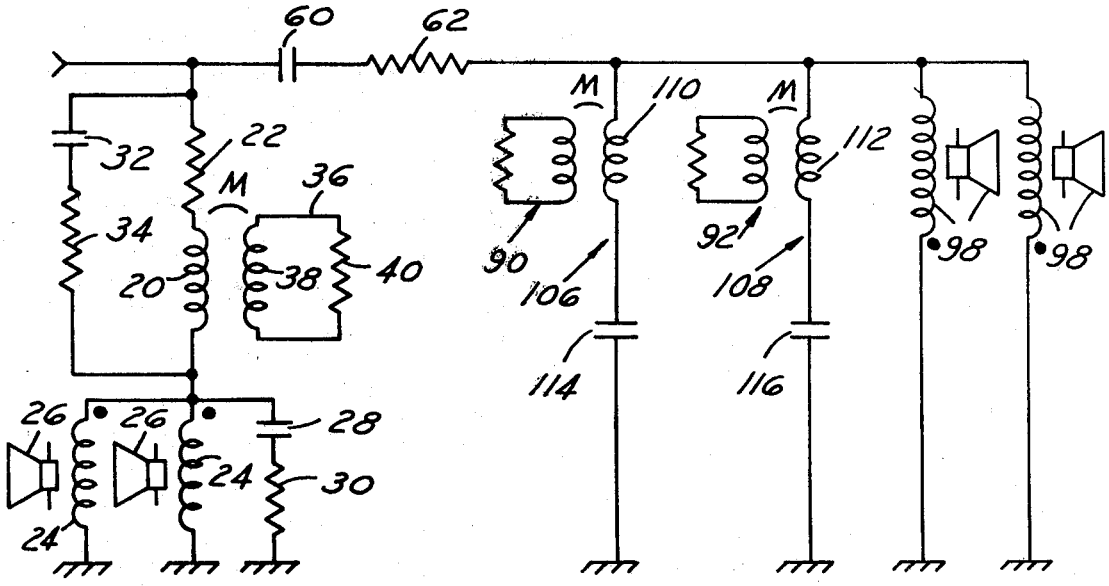
FIG. 11 is a schematic of a cross-over network incorporating triple inductively coupled circuits; and, FIG. 12 is a plot of frequency versus acoustic output for a complete loudspeaker combination.

In FIGS. 8 and 11 the inductively coupled circuits are applied to cross-over networks. The network of FIG. 8 consists of a low frequency filter driving a pair of low frequency drivers on the left and a high frequency filter driving a pair of high frequency drivers on the right. The low pass filter includes an inductively coupled shunt circuit 36 and is basically the circuit of FIG. 2. The high pass filter includes parallel resonant circuits 106 and 108 with inductances 110 and 112 and capacitances 114 and 116 selected for resonance at the high frequency driver cutoff frequency and a suitable second frequency thereabove.

As in the description for FIG. 10 above the capacitance 116 is 7/10ths the capacitance 114 or the inductance 112 is 7/10ths the inductance 110, the other elements being equal. This ratio has been determined empirically to best flatten the phase curve. The dual resonant circuits increase the damping of the high frequency driver above the resonant driver frequency thus producing the very smooth roll-off of curve 94 and the flat phase response. As noted above the resistance 70 in FIG. 7 is as low as possible and therefore deleted from circuits 106 and 108 of FIG. 8. The cross-over of FIG. 11 is basically the combination of the cross-over of FIG. 8 and the high pass filter of FIG. 10. The parallel resonant circuits 106 and 108 are combined with inductively coupled shunt circuits 90 and 92 to fine tune the improved roll-off characteristics of curve 94 in FIG. 9.

In practice the precise frequency and phase response adjustments above allow a coupling effect to be utilized for superior efficiency. Ideally the high frequency and low frequency drivers should be coincident in space, however, if optimally located within a fraction of a wavelength and where the low frequency and high frequency signal are closely in phase at the cross-over frequency the coupling effect is effective. Additionally, the phase response of the combination of drivers and filters must remain substantially linear outside of the pass bands of the filters for the greatest radiating efficiency through the cross-over range between the high pass and low pass bands.

Figure 12:
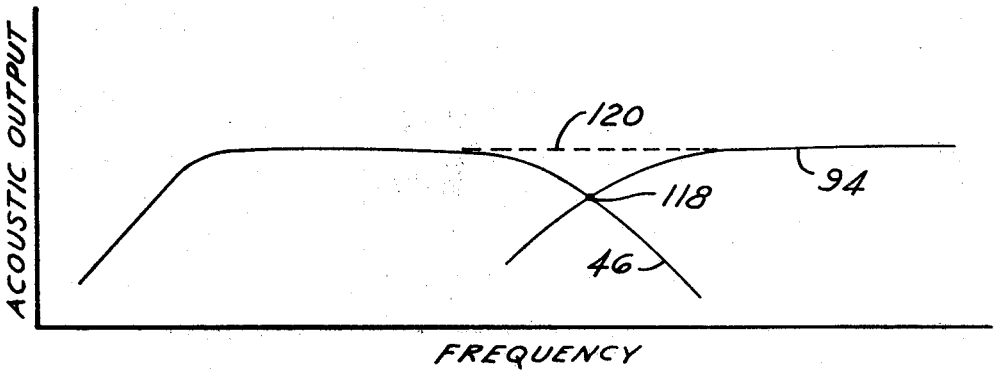

In practice a high frequency and a low frequency driver are spaced less than one half wavelength apart and the desired attenuation of each filter-driver combination is adjusted to −6 db at the actual cross-over frequency as shown at 118 in FIG. 12. The coupling effect levels the acoustic output through the cross-over frequency as shown at 120. This is distinguished from the conventional placement of speakers more than one wavelength apart with a −3 db attenuation at the cross-over frequency. An additional result is a substantial doubling of the radiating efficiency of applicant's speaker systems over what would be expected from the drivers and a conventional cross-over network.

The shorted coil inductively coupled circuits disclosed above have proven to be particularly effective means of adjusting the filter circuits to compensate for deviations in driver performance among drivers from the same maufacturer or differing manufacturers although the drivers meet overall specifications. For best performance the acoustic output for each channel of a stereophonic or quadraphonic hi-fidelity system should be identical. Thus, the cross-over network for each channel should exactly compensate for the electroacoustic mis-match of the corresponding drivers connected thereto. The shorted coil inductively coupled circuits disclosed above allow the drivers for each channel to be carefully matched during assembly to obtain the results disclosed above.

The filter and cross-over circuits disclosed above are shown directly connected to the electroacoustic drivers, however, other passive or active elements may be interposed between a filter and a corresponding driver or within a filter. As an example, a power amplifier can be interposed between the filter and driver.

A flat or linear phase response in this application is a time delay compensated phase response that is substantially independent of frequency. On a plot of phase angle versus frequency a flat or linear phase response is a horizontal line. The procedures for carefully adjusting the phase response outside of the pass bands to a substantially flat or linear response while retaining the linear phase response within the pass bands allows a careful matching at the cross-over frequency. Combined with an equal phase response at the cross-over frequency the coupling effect of the high and low frequency drivers is most effective.

I claim:

1. In an electric loudspeaker circuit comprising at least one electroacoustic driver, an acoustic frequency filter connected to said driver, said filter including a first inductance and a resistance in series with each other and in series with said driver and a capacitance in parallel with said driver, the improvement characterized by, a second circuit comprising at least one inductance, said inductance in the second circuit positioned for magnetic coupling to the first inductance, said first inductance and second circuit being selected and adjusted for substantially linear phase response of the driver and filter combination within and beyond the pass band.

2. The electric circuit of claim 1 wherein the second circuit inductance comprises a shorted coil.

3. The electric circuit of claim 1 wherein the second circuit inductance comprises a metal ring surrounded by the first inductance.

4. The electric circuit of claim 3 wherein the metal ring is physically positioned within the first inductance to provide the substantially linear phase response.

5. The electric circuit of claim 3 wherein the depth of the metal ring within the first inductance is adjustable.

6. The electric circuit of claim 1 wherein the second circuit includes a shorting switch.

7. The electric circuit of claim 1 including a second capacitance in series with a second driver and a pair of series resonant circuits each in parallel with the second driver and comprising an inductance and a capacitance.

8. The electric circuit of claim 7 wherein at least one second circuit is magnetically coupled to at least one of the series resonant circuit inductances.

9. The electric circuit of claim 8 wherein each second circuit comprises a metal ring.

10. In a crossover network comprising a high pass acoustic frequency filter and at least one high frequency electroacoustic driver, said high pass filter including a capacitance and a resistance in series with each other and in series with said high frequency driver and at least one inductance in parallel with said high frequency driver, and a low pass acoustic frequency filter and at least one low frequency electroacoustic driver, said low pass filter including an inductance and a resistance in series with each other and in series with said low frequency driver and a capacitance in parallel with said low frequency driver, the improvement characterized by, at least one second circuit comprising at least one electric component, said second circuit being inductively coupled to one of said inductances, and, said coupled inductance and second circuit electric component being selected and adjusted for substantially flat amplitude response through the cross-over frequency between the filter pass bands.

11. The cross-over network of claim 10 including a plurality of second circuits each inductively coupled to individual inductances.

12. The crossover network of claim 10 wherein the second circuit comprises a shorted coil inductively coupled to said inductance in the low pass filter.

13. The cross-over network of claim 12 wherein the shorted coil comprises a copper ring.

14. The cross-over network of claims 12 or 13 wherein the high pass filter includes a plurality of resonant circuits.

15. The cross-over network of claim 10 wherein the high pass filter includes a plurality of resonant circuits, an inductance in at least one resonant circuit, and at least one second circuit inductively coupled to the resonant circuit inductance.

16. The cross-over network of claim 15 wherein the second circuits comprise shorted coils.

17. The cross-over network of claim 16 wherein the shorted coils comprise copper rings.

18. The cross-over network of claim 15 wherein the low pass filter includes at least one inductance and a second circuit inductively coupled to said low pass filter inductance.

19. The cross-over network of claim 10 wherein the high pass filter and the low pass filter each separately produce an approximately −6 db attenuation in acoustic output at the cross-over frequency.

20. In an electric loudspeaker circuit comprising at least one electroacoustic driver, an acoustic frequency filter connected to said driver, said filter including a resistance and a capacitance in series with the driver and in series with each other, the improvement characterized by, a plurality of separate series resonant circuits in parallel with the electroacoustic driver and in parallel with each other, said series resonant circuits located between at least a portion of said filter and said driver, and, said separate series resonant circuits being selected and adjusted to produce a smooth rolloff of amplitude response and a flat phase response within and beyond the pass band of the filter.

21. The electric circuit of claim 20 wherein the resistance of at least one of the resonant circuits is substantially limited to that inherent in the capacitance and inductance.

22. The electric circuit of claim 20 wherein the inductance of a first series resonant circuit is substantially 0.7ths of the inductance of a second series resonant circuit in parallel with the first resonant circuit.

23. The electric circuit of claim 20 wherein the capacitance of a first series resonant circuit is substantially 0.7 of the capacitance of a second series resonant circuit in parallel with the first resonant circuit.

24. The electric circuit of claim 20 including at least one second circuit, said second circuit including an inductance and being inductively coupled to one of said series resonant circuits.

25. The method of optimizing the performance of an electric loudspeaker circuit including an acoustic frequency filter comprising the steps of, applying a step or impulse signal to the input of the loudspeaker, analyzing the amplitude and phase spectrum of the acoustic output of the loudspeaker, and, adjusting the magnetic coupling between an inductance and second circuit in a filter in the loudspeaker to provide a linear phase response within and outside the pass band of the filter.

26. The method of optimizing the performance of an electric loudspeaker circuit including an acoustic frequency filter comprising the steps of, applying a step or impulse signal to the input of the loudspeaker, analyzing the amplitude and phase spectrum of the acoustic output of the loudspeaker, adjusting the magnetic coupling between an inductance and second circuit in a filter in the loudspeaker to provide a linear phase response within and outside the pass band of the filter and smooth roll-off of the amplitude response from the pass band through the crossover frequency, and, repeating the above steps for a second filter in the loudspeaker until a substantially flat amplitude response through the crossover frequency between the filter pass bands is obtained.

27. The method of claim 28 including the additional step of further adjusting at least one magnetic coupling to fine tune the flat amplitude and linear phase response for minimum energy input to the loudspeaker for a given level of sound intensity at the expected position of the listener.

28. In an electric loudspeaker circuit comprising at least one electroacoustic driver, an acoustic frequency filter connected to said driver, said filter including a capacitance and a resistance in series with each other and in series with said driver and a first inductance in parallel with said driver, the improvement characterized by, a second circuit comprising at least one inductance, said inductance in the second circuit positioned for magnetic coupling to the first inductance, said first inductance and second circuit being selected and adjusted for substantially linear phase response of the driver and filter combination within and beyond the pass band.

29. The electric circuit of claim 28 wherein the second circuit inductance comprises a shorted coil.

30. The electric circuit of claim 28 wherein the second circuit inductance comprises a metal ring surrounded by the first inductance.

31. The electric circuit of claim 30 wherein the metal ring is physically positioned within the first inductance to provide the substantially linear phase response.

32. The electric circuit of claim 30 wherein the depth of the metal ring within the first inductance is adjustable.

33. The electric circuit of claim 28 wherein the second circuit includes a shorting switch.

* * * * *